US005449245A

United States Patent [19]

Glickman

[11] Patent Number: 5,449,245

[45] Date of Patent: Sep. 12, 1995

[54] PAVING BLOCK WITH IMPROVED WATER RUN-THROUGH

[75] Inventor: Michael N. Glickman, London, United Kingdom

[73] Assignee: McCauley Limited, United Kingdom

[21] Appl. No.: 72,600

[22] Filed: Jun. 3, 1993

[30] Foreign Application Priority Data

Jun. 3, 1992 [GB] United Kingdom ..... 9211701

[51] Int. Cl.[6] ..... E01C 5/06

[52] U.S. Cl. ..... 404/38; 404/41

[58] Field of Search ..... 404/34, 35, 37, 38, 404/39, 42, 2, 4, 19, 41; 52/311.1, 311.2

[56] References Cited

U.S. PATENT DOCUMENTS 1,463,979 8/1923 Stubbs ..... 404/19 X

FOREIGN PATENT DOCUMENTS 224678 11/1960 Austria ..... 404/41
815276 4/1937 France ..... 404/41
1534350 8/1971 Germany .
2502975 7/1976 Germany .
3235383 3/1984 Germany ..... 404/41
3326109 2/1985 Germany ..... 404/42
8428759 5/1987 Germany .
233626 6/1925 United Kingdom .

OTHER PUBLICATIONS

National Bureau of Standards Technical Note 536, pp. 4,5 (Jun. 1970).

*Primary Examiner*—David J. Bagnell
*Assistant Examiner*—James A. Lisehora
*Attorney, Agent, or Firm*—Renner, Otto, Boisselle & Sklar

[57] ABSTRACT

A paving block (10) has substantially parallel top and bottom surfaces, is based upon hexagonal geometry and has a central portion (10*a*) which is a substantially equilateral triangle and three portions (10*b*) (herein called apex portions) Each apex portion is located in the region which would otherwise be the location of a respective apex of the triangle. Each apex portion has a first pair of walls (17) each of which in part defines a boundary of one of three recesses in the block and a third wall (17*c*) which defines an outer boundary of the respective apex portion. The third wall is shaped to secure an interfit between a recess of one block and an apex portion of an adjacent similar block, the interfit being incomplete and arranged to define one of a plurality of water run-away holes (20) in an array of laid blocks.

4 Claims, 4 Drawing Sheets

PAVING BLOCK WITH IMPROVED WATER RUN-THROUGH

BACKGROUND OF THE INVENTION

This invention relates to a paving block.

Many kinds of paving block are known. With increasing interest in ecological matters, a demand has arisen for a paving block which is easily laid, attractive in appearance, and is constructed to facilitate a rapid yet distributed run-through (percolation) of rainwater.

According to one aspect of the present invention there is provided a block with substantially parallel top and bottom surfaces, which is based upon hexagonal geometry and which has a central portion which is a substantially equilateral triangle and three portions (herein called apex portions) each being located in the region which would otherwise be the location of a respective apex of the triangle, each apex portion having a first pair of walls each of which in part defines a boundary of one of three recesses in the block and a third wall which defines an outer boundary of the respective apex portion, the third wall being shaped to secure an interfit between a recess of one block and an apex portion of an adjacent similar block, the interfit being incomplete and arranged to define one of a plurality of run-away holes in an array of laid blocks.

SUMMARY OF THE INVENTION

Although an apex portion is defined as having three walls, these walls could smoothly merge to form a continuous curve, as can be seen from FIGS. 6 and 8.

In another aspect of the invention a paving block has a flat body portion having three apex portions each apex portion having at least two symmetrically disposed corners, the body and apex portions being shaped to define together with an identical adjacent block at least one aperture into which run-off water can pass; the block being characterised in that the aperture is in part defined by a chamfer located at the junction of a side wall and the top surface of the block, the said chamfer diminishing to substantially zero as one moves from a boundary of the recess to a corner of an apex of the block.

In a preferred embodiment of the invention, the paving blocks have flat top and bottom surfaces but the invention also extends to paving blocks having ridged or undulating or stippled top and bottom surfaces.

Reference has been made above to parts of the edges of the blocks being chamfered. The angle of this camfer may 25–45 degrees to the horizontal, or more preferably 30–40 degrees, or, most preferably, 33 degrees to 39 degrees to the horizontal.

A significant advantage of an array of blocks according to the illustrated embodiments of the invention is, as stated, that water run-off is facilitated. Another advantage is that the secure interlock is obtained between adjacent blocks. This arises particularly because the convexly curved walls 17 of one block have a curvature substantially equal to the concavely-curved walls of an adjacent block in the array, as can be seen from FIGS. 2, 7 and 8.

BRIEF DESCRIPTION OF THE DRAWINGS

The invention will be better understood from the following particular description of examples thereof, given with reference to the accompanying drawings, in which.

DETAILED DESCRIPTION

Figure 1:
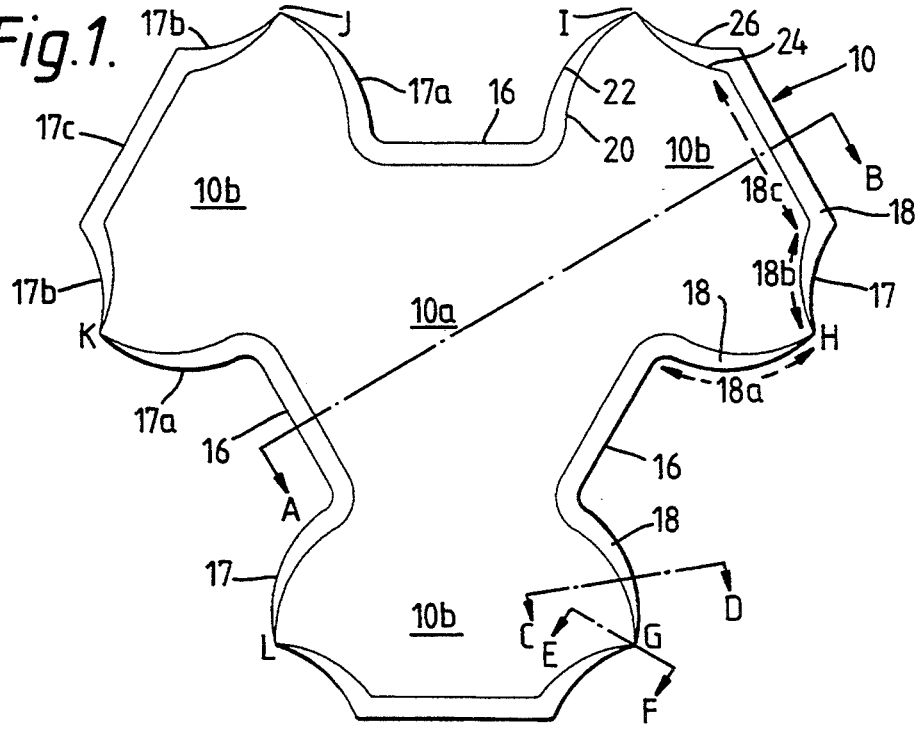
FIG. 1 is a plan view of one example of block according to the invention.
Figure 2:
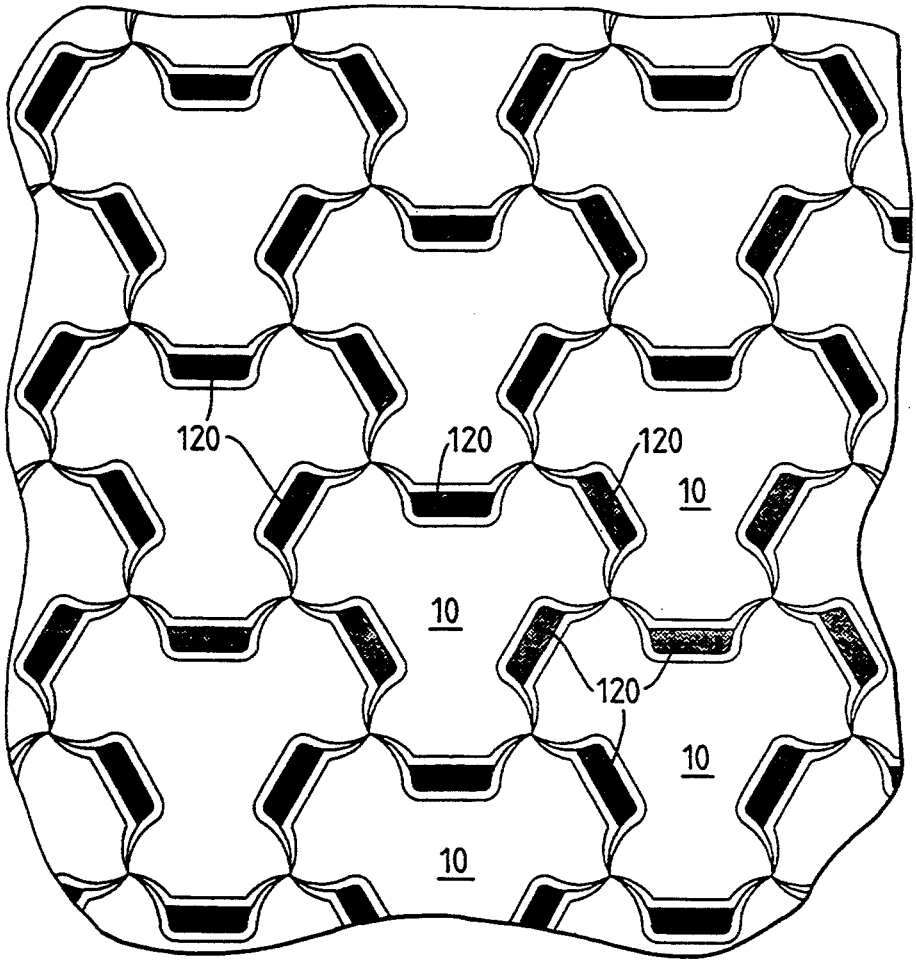
FIG. 2 is a plan view showing paving made up of a number of blocks of the kind shown in FIG. 1.
Figure 3:
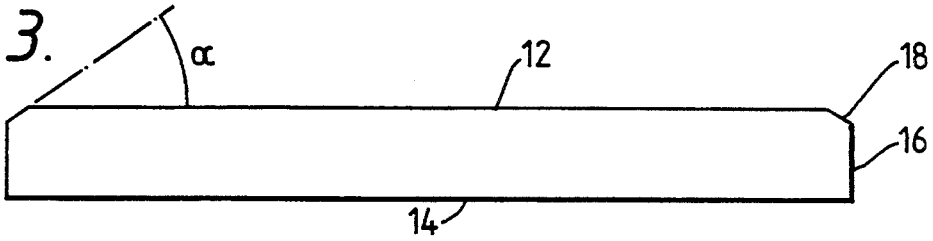
FIG. 3 is a cross section on the line A–B of FIG. 1.
Figure 4:
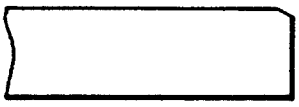
FIG. 4 is a cross section on the line C–D of FIG. 1.
Figure 5:
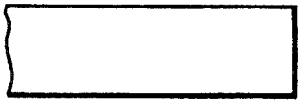
FIG. 5 is a cross section on the line E–F of FIG. 1.

Referring firstly to FIGS. 1–5 the block 10 of FIG. 1 has a central portion 10*a* which is substantially an equilateral triangle and three so-called apex portions 10*b*. These apex portions 10*b* are located at the notional apices of the triangle referred to. Each apex portion is itself defined by contiguous wall portions whose shape varies according to the area of run-off apertures required in the laid paving. As seen in FIG. 1, an apex portion 10*b* has substantially flat and parallel top and bottom surfaces and is defined by two walls 17*a* of convex shape and two walls 17*d* of concave shape. The walls 17*b* merge with a straight wall 17*c*. The walls 17*a* and 17*b* meet at corners K and J. The illustrated block 10 (FIGS. 1–5) has parallel smooth top and bottom surfaces 12, 14 and is bounded by substantially vertical marginal walls 16 and 17, the straight walls being referenced 16 and the curved walls being referenced 17. There is a chamfer 18 at the junction of the walls 16 and 17 with the top surface 12. This chamfer is in the preferred embodiment of the invention of variable width but constant angle to the horizontal. As seen in FIG. 3, the chamfer angle alpha is approximately 33 degrees but other angles within the indicated ranges could be employed. Along the straight sides of the block of FIG. 1, which are six in number, the chamfer 18 is of constant width but in the curved regions as indicated the chamfer tapers away to zero as seen in plan. Zero chamfer, i.e. a full height vertical wall as seen in FIG. 5, occurs in the preferred design of block only at the six points marked G, H, I, J, K and L which constitute the apices of a regular hexagon. In other words, over the region of chamfer 18*a* in FIG. 1, the width of the chamfer tapers from a fixed value (e.g. 6 mm) along the straight portion 18*c* to zero at the point H. Similarly, along the length of chamfer indicated at 18*b*, the chamfer width tapers from the standard width at the widest portion to zero at the point H. This structure is advantageous because when blocks are assembled to make an area of paving as seen in FIG. 2, these chamfers combine to provide run-off channels tending to convey any rainwater or other liquid which has fallen on the paving towards the run-away apertures seen shaded at 120 in FIG. 2.

In the preferred embodiment of the invention, the points indicated G, H, I, J, K and L in FIG. 1 are the corners of a regular hexagon. In a block of preferred dimensions according to the present invention, this hexagon is one which is exactly circumscribed by a circle of 100 millimeters radius. An advantageous dimension for the width of the chamfer 18 along a straight portion is 6 millimeters. Of course other dimensions may be chosen without departing from the invention.

In a particularly preferred embodiment of the invention, the lines 20 and 22, which define the portion of decreasing chamfer, are arcs of circles having a radius 36.5 millimeters, and the lines 24, 26, are similarly arcs of circles having a radius 36.5 millimeters. In other words, the width as one moves away from the point I in either direction increases. As can be understood from FIGS. 1 and 2, an important advantage of the invention is that the region of paving made up of blocks according to the invention is particularly stable. In other words, the interlock between blocks, since there are no joins which have straight lines extending the length of several blocks, is particularly resistant to slippage or deformation even when subjected to horizontal forces coupled with heavy loading, such as may be applied by heavy vehicles accelerating. The interfit of the curved walls also contributes to this advantage.

The arrangement illustrated in FIG. 2 provides an area of paving of which the apertures (run-away holes) amount to approximately 9% of the paving area. These apertures are scattered fairly uniformly over the whole surface and consequently provide numerous paths for rainwater to run away. Also, growth of grass or other plants may occur in the apertures 20, leading to a paved area of attractive appearance.

The paving may be laid in conventional manner. For example, one may put down a base layer of crushed stone, cover this with a known geofabric, place upon the geofabric a sand layer, and then place the blocks on top of the sand layer. The presence of the geofabric prevents the sand being washed into the crushed stone.

Figure 6:
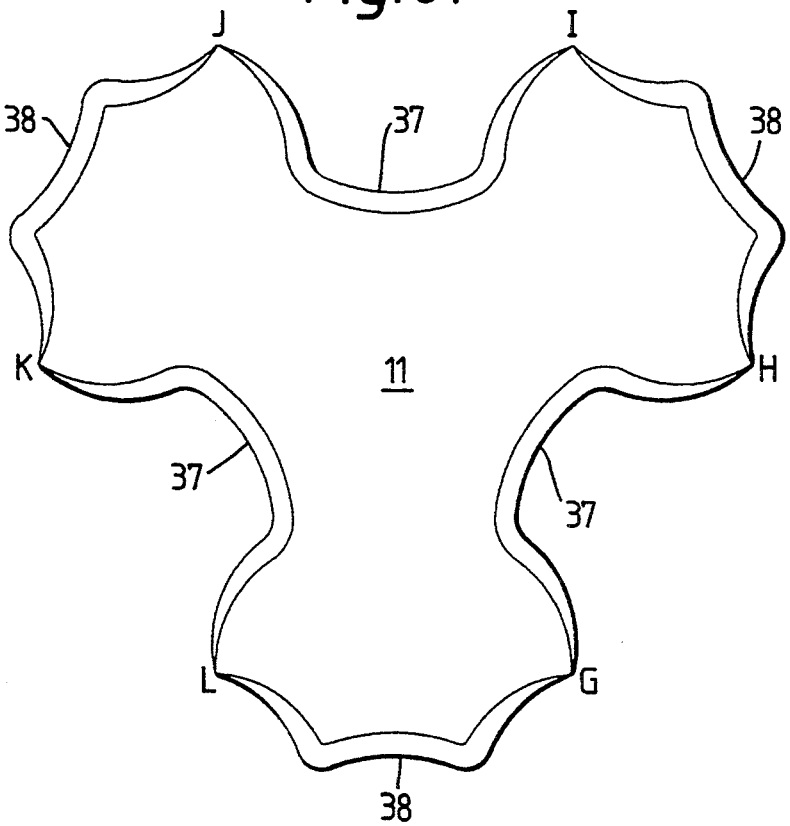
FIG. 6 is a plan view similar to FIG. 1 showing a second embodiment of the invention.
Figure 7:
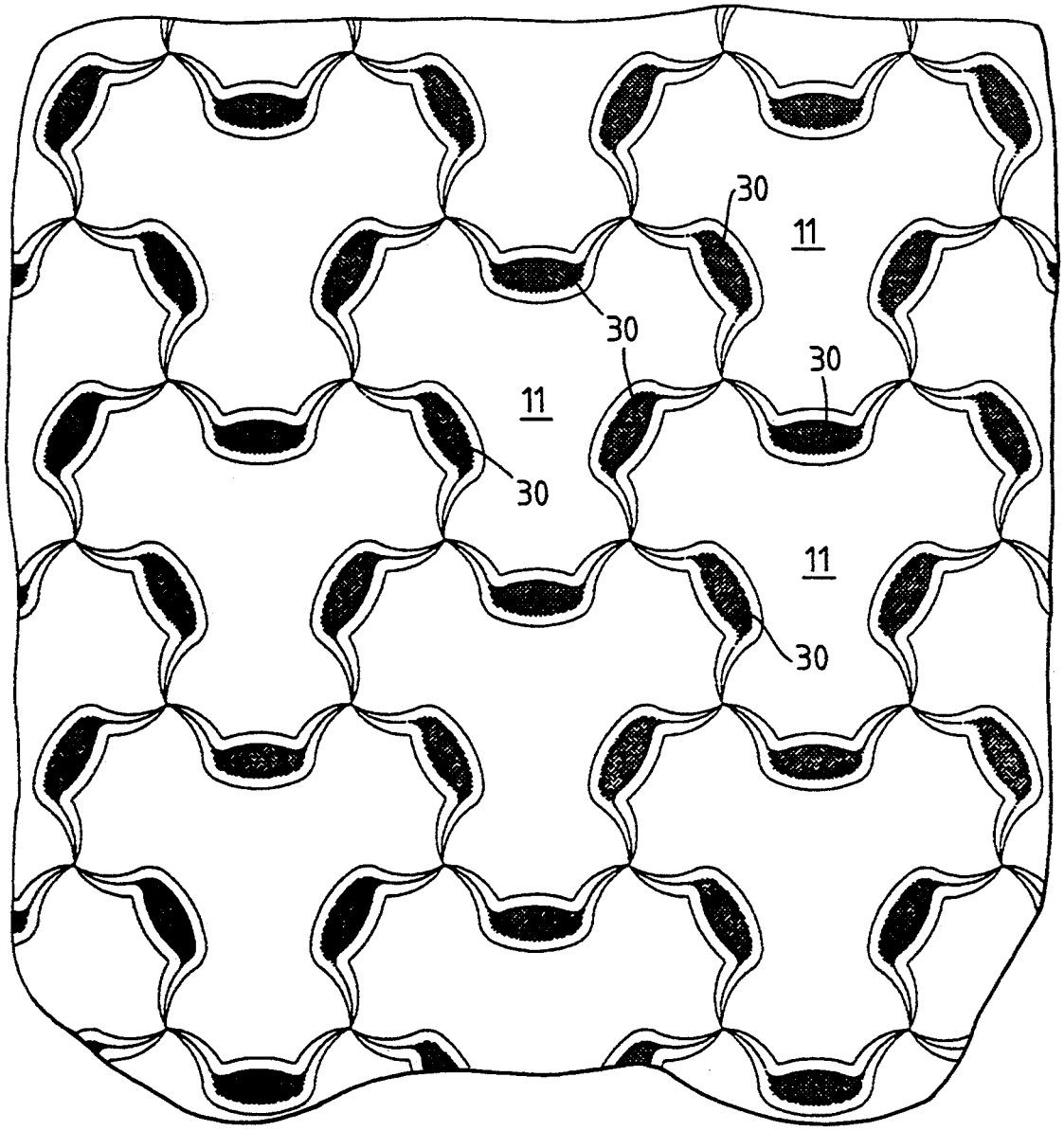
FIG. 7 is a plan view of laid paving employing the blocks according to FIG. 6.

The embodiment of the invention illustrated in FIGS. 6 and 7 is similar in essential concept to that shown in FIG. 1 except that the shape of the block is slightly different. The inner straight portions 16 of FIG. 1 are concavely curved (37) in the FIG. 6 embodiment, and the outer straight portions 16 of FIG. 1 are also slightly concavely curved (38), so increasing the area of each aperture defined by adjacent blocks 11. The advantage of the paving illustrated in FIGS. 6 and 7 is that approximately 11% of the paved area is constituted by apertures. This therefore allows more effective run-off of water.

Figure 8:
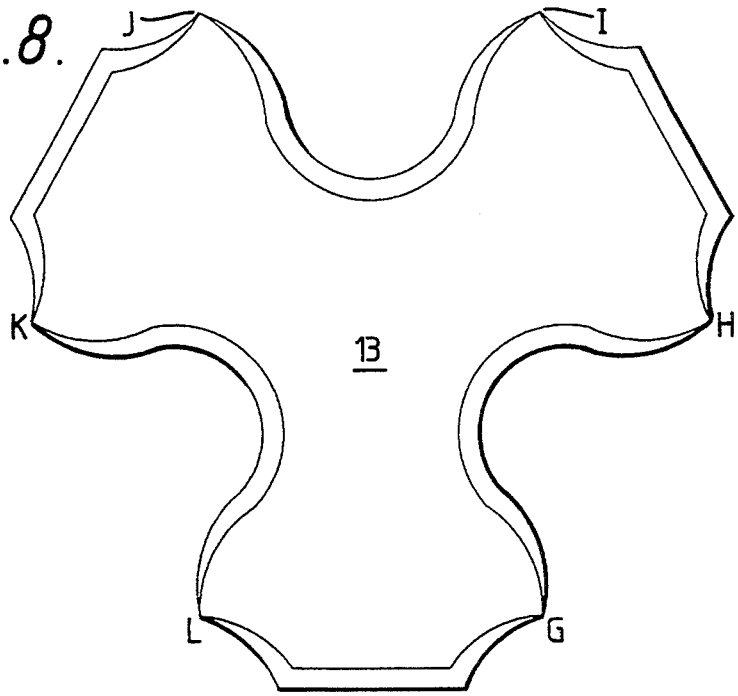
FIG. 8 is a plan view of a block according to a third embodiment of the invention and FIG. 9 is a plan view of an array of blocks in accordance with FIG. 8.
Figure 9:
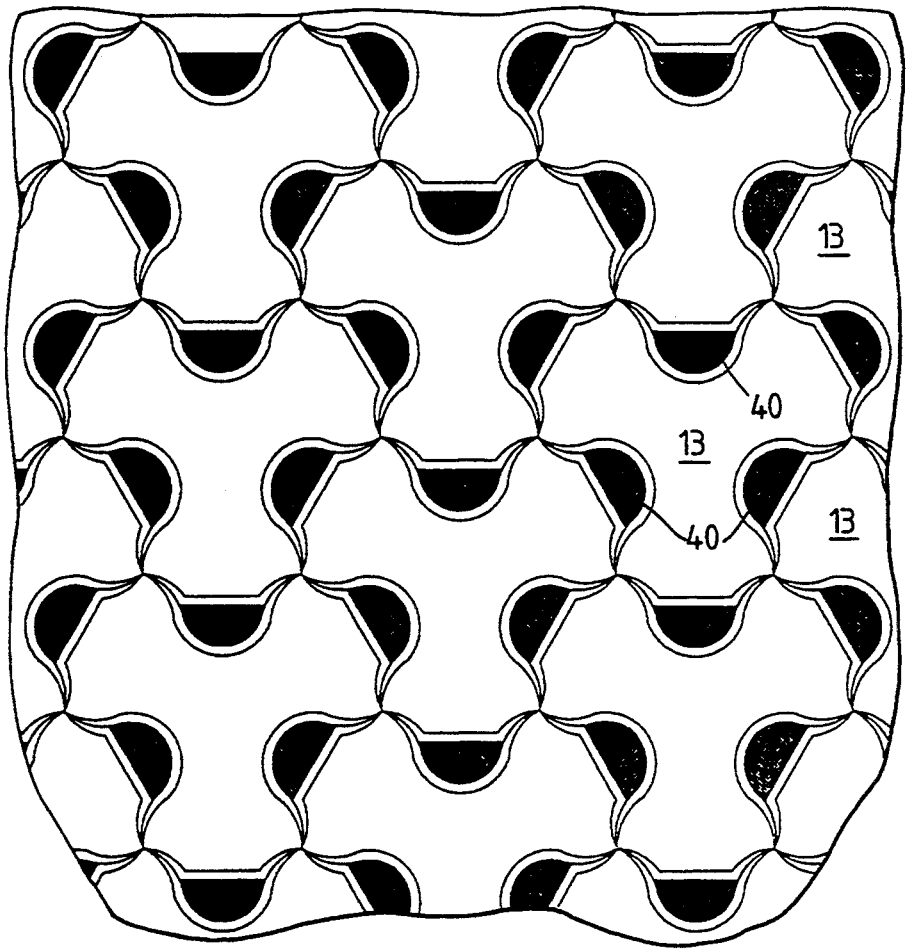

The embodiment of the invention seen in FIGS. 8 and 9 is also based on the same essential concept as the first and second embodiments, but here the curvature of the block has been increased with the result that the apertures 40 are larger than in FIG. 6. As will be seen by comparing FIGS. 6 and 7 with FIGS. 8 and 9, in the block 13 of FIG. 8, the apertures 40 are larger than the apertures 30 due to the greater curvature (e.g. achieved by a lesser radius) of the portions 47 of block wall (FIG. 8) compared to the portions 37 seen in FIG. 6. An array of paving as shown in FIG. 9 has apertures which amount to approximately 14% of the total area of the laid paving. This third embodiment consequently could be employed in a geographical region subject to frequent heavy rainfall.

The blocks according to the second and third embodiment of the invention preferably have a similar arrangement of chamfer as the blocks shown in FIG. 1. However, neither this chamfer nor its tapering nature is to be considered an essential feature of the invention. Blocks having no chamfer at all but of the general outline indicated in FIGS. 1, or 6, or 8 will provide constructionally satisfactory paving of good aesthetic appearance and with advantageous water run-off properties even in the absence of the tapering chamfer arrangement which is a particular feature of the preferred embodiment of this invention. Other advantages of the invention are that it reduces the need for long-distance draining, and that it helps maintenance of the local water table. In addition, the local microclimate may be improved.

What is claimed is:

1. A paving block having substantially flat and parallel top and bottom surfaces, a central portion which is a substantially equilateral triangle and three apex portions each being located in a region which would otherwise be the location of a respective apex of the triangle, there being three recesses, each located between a respective pair of apex portions, each apex portion having a first pair of walls each of which in part defines a boundary of one of the three recesses in the block and a third wall which defines an outer boundary of the apex portion, the third wall being shaped to secure an interfit between a recess of one block and an apex portion of an adjacent similar block, the interfit being incomplete and arranged to define one of a plurality of run-away holes in an array of laid blocks, wherein each wall of said first pair of walls is convex and wherein the third wall of each apex portion is in part defined by a pair of concave walls each of which has a curvature which is complimentary to the curvature of the convexity of the said pair of first walls.

2. An array of paving blocks, each such block having substantially flat and parallel top and bottom surfaces, a central portion which is a substantially equilateral triangle and three apex portions each being located in a region which would otherwise be the location of a respective apex of the triangle, there being three recesses, each located between a respective pair of apex portions, each apex portion having a first pair of walls each of which in part defines a boundary of one of the three recesses in the block and a third wall which defines an outer boundary of the apex portion, the third wall being shaped to secure an interfit between a recess of one block and an apex portion of an adjacent similar block, the interfit being incomplete and arranged to define one of a plurality of run-away holes in an array of laid blocks; the incomplete interfit being that achieved by virtue of the equal curvature of a pair of convexly-curved walls on the apex of one block and a pair of concavely-curved walls on said adjacent block.

3. A paving block according to claim 1 in which the edge defining the outline of the block is chamfered.

4. A block according to claim 3 in which the chamfer is of varying width along its length.

* * * * *